US010876425B2

(12) United States Patent
Humhauser

(10) Patent No.: US 10,876,425 B2
(45) Date of Patent: Dec. 29, 2020

(54) LEVER CONNECTION OF A GUIDE VANE ADJUSTMENT FOR TURBOMACHINERY

(71) Applicant: MTU Aero Engines AG, Munich (DE)

(72) Inventor: Werner Humhauser, Moosburg (DE)

(73) Assignee: MTU Aero Engines AG, Munich (DE)

( * ) Notice: Subject to any disclaimer, the term of this patent is extended or adjusted under 35 U.S.C. 154(b) by 40 days.

(21) Appl. No.: 16/271,842

(22) Filed: Feb. 10, 2019

(65) Prior Publication Data

US 2019/0249562 A1 Aug. 15, 2019

(30) Foreign Application Priority Data

Feb. 12, 2018 (DE) ..... 10 2018 202 119

(51) Int. Cl.
*F01D 17/16* (2006.01)
*F04D 29/56* (2006.01)
*F01D 9/04* (2006.01)

(52) U.S. Cl.
CPC ..... *F01D 17/162* (2013.01); *F01D 9/041* (2013.01); *F01D 9/042* (2013.01); *F04D 29/563* (2013.01); *F05D 2230/60* (2013.01); *F05D 2250/294* (2013.01); *F05D 2260/36* (2013.01); *F05D 2260/50* (2013.01); *F05D 2260/79* (2013.01)

(58) Field of Classification Search
CPC .... F01D 17/162; F01D 17/165; F01D 17/167; F01D 9/041; F01D 9/042; F01D 29/563; F04D 29/563; F05D 2250/294; F05D 2230/60; F05D 2260/36; F05D 2260/79; F05D 2260/50
See application file for complete search history.

(56) References Cited

U.S. PATENT DOCUMENTS 4,979,874 A * 12/1990 Myers ..... F01D 7/00 415/160
6,019,574 A * 2/2000 DiBella ..... F01D 17/162 415/148
8,651,803 B2 * 2/2014 Jones ..... F04D 29/563 415/160
9,988,926 B2 * 6/2018 Gasmen ..... F01D 17/14
10,208,618 B2 * 2/2019 Gasmen ..... F04D 29/563
10,577,958 B2 * 3/2020 Kennedy ..... F01D 9/041
10,590,795 B2 * 3/2020 Pratt ..... F02C 9/20
2005/0169741 A1 8/2005 Kies et al.
2006/0062667 A1 3/2006 Bourgoin et al.
(Continued)

FOREIGN PATENT DOCUMENTS

DE 69505074 T2 3/1999
DE 202010008214 U1 2/2011
(Continued)

*Primary Examiner* — Brian P Wolcott
(74) *Attorney, Agent, or Firm* — Barlow, Josephs & Holmes, Ltd.

(57) ABSTRACT

Disclosed is a lever connection for a guide vane adjustment for connecting a guide vane of a turbomachine to an adjusting ring of an actuator, which is arranged in such a way that an adjusting lever of the lever connection is pushed radially from a first mounting direction, in relation to a machine longitudinal axis of the turbomachine, onto a vane shaft of the guide vane, and is locked with the vane shaft in a form-fitting and, in particular, rotationally rigid manner by a movement in a second mounting direction; a mounting method; and a turbomachine.

7 Claims, 4 Drawing Sheets

(56) References Cited

U.S. PATENT DOCUMENTS

Figure 1:
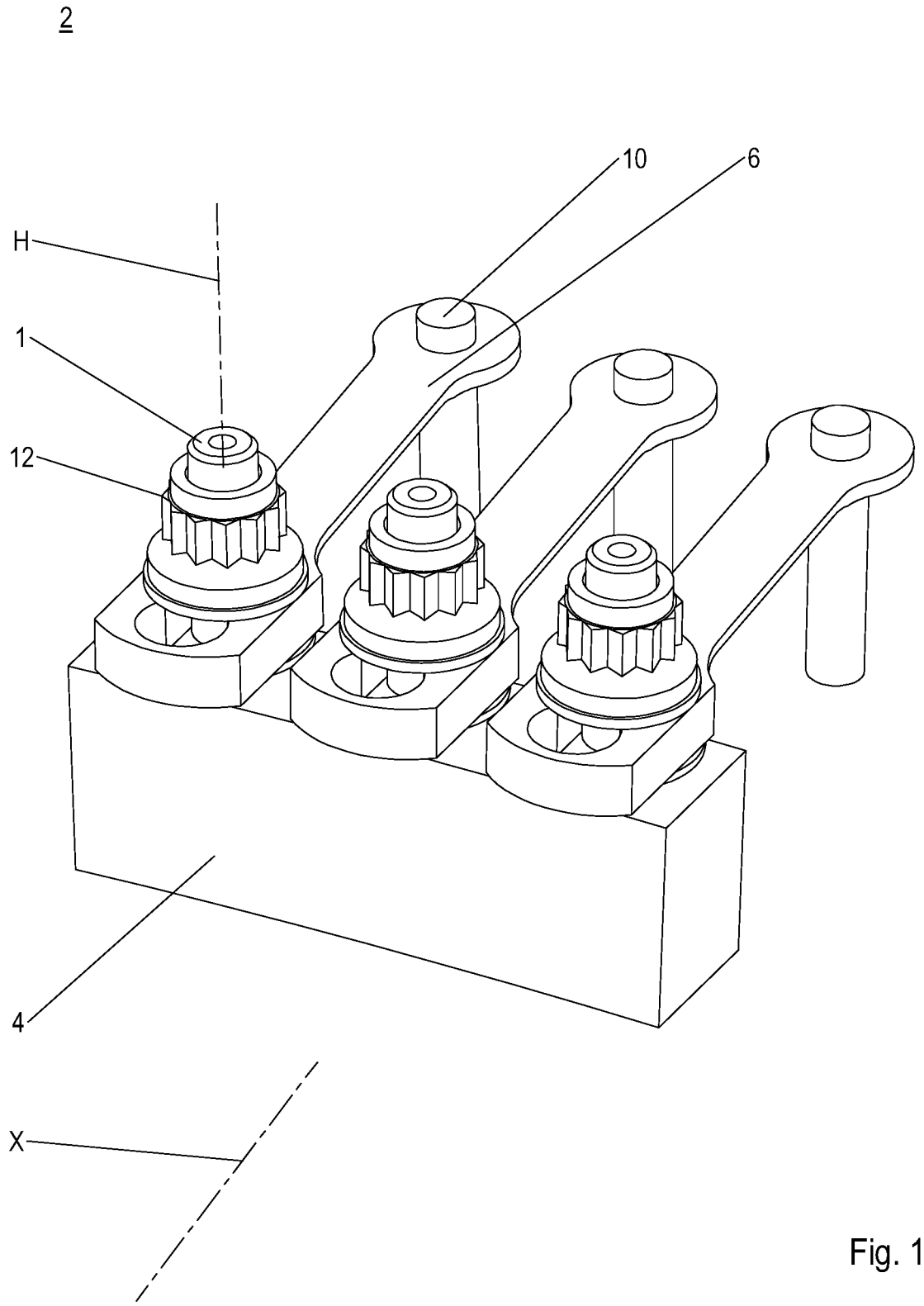

| | | | |
|---|---|---|---|
| 2008/0107520 | A1 | 5/2008 | Battig et al. |
| 2011/0058932 | A1 | 3/2011 | Jones et al. |

FOREIGN PATENT DOCUMENTS

| | | | |
|---|---|---|---|
| EP | 2273074 | B1 | 5/2012 |
| EP | 1561906 | B1 | 3/2013 |
| EP | 3495625 | A1 | 6/2019 |

* cited by examiner

LEVER CONNECTION OF A GUIDE VANE ADJUSTMENT FOR TURBOMACHINERY

BACKGROUND OF THE INVENTION

The invention relates to a lever connection for a guide vane adjustment in a turbomachine for producing a connection between a guide vane and an actuator in accordance with the preamble of patent claim 1, a method for producing a connection between a guide vane and an actuator, and a turbomachine.

Compressors in axial turbomachines, such as, for example, aircraft engines, have, as a rule, a guide vane adjustment in the region of the front compressor stages or in the high-pressure compressor. The guide vane adjustment enables the guide vanes of the relevant guide vane row to be adjusted around their vertical axis depending on the rotational speed, so that an absolute guide wheel outflow angle can be varied. In this way, it is possible to prevent any flow stall during startup of the turbomachine or at low rotational speeds. A load of the stages is reduced. Alternatively, a flow stall could also be brought about by an adjustment of the rotating blades of the compressor stages, but this is appreciably more complicated in technical terms, so that the adjustment of the guide vanes has prevailed.

The adjustment of the guide vanes of a guide vane row conventionally occurs mechanically by operation of an actuator. The actuator acts on the guide vanes via an adjusting ring and a respective adjusting lever. The adjusting ring is arranged outside of the turbomachine, and, as viewed in the flow direction, is usually positioned behind and coaxially to the guide vane row. It can be displaced in the peripheral direction and in the axial direction of the turbomachine. In the case of a plurality of compressor stages that are to be adjusted, the adjusting rings are controlled simultaneously via a control lever of the actuator that is rotatably mounted on the compressor housing, extends in the axial direction of the turbomachine, and is connected to the adjusting rings.

In known guide vane adjustments, the adjusting lever, which, for reasons of simplicity, is also referred to below simply as a lever, extends in the radial direction of the turbomachine on a vane shaft that extends in the vertical direction of the guide vane. Afterwards, the lever is fixed in place at a contact region of the vane shaft in a form-fitting manner and secured in position by a screw connection. The screw connection can be produced by an inner thread or by an outer thread. This kind of lever connection necessitates a sufficiently thick vane shaft for the shaping of the contact surfaces. However, on account of geometric constraints, such as small flow channel diameters and large number of vanes, the shaft can be hardly larger than the smallest possible outer thread. When, on account of geometric constraints, the shaft diameter needs to be markedly reduced, the previously described known lever connection can no longer be presented when the shaft diameters are barely larger than the allowable thread size. Thus, for compressors of jet engines, a demand is placed on a marked decrease in the geometry, that is, on a miniaturization of the adjusting vanes, too, as well as their connection with an adjusting lever. Conventional connection systems via airfoil pitches, cone geometries, and the like necessitate a reduction in the diameter of the vane shaft in the outer region thereof, which no longer permits the utilization of bolts and nuts having a minimum thread diameter of M5.

The published prior art is shown in the patent EP 1 561 906 B1. In the lever connection shown there, the adjusting lever has a claw-like connecting section for connection to a vane shaft. The connecting section has two opposite-lying claw elements, which extend from a bottom side of the adjusting lever and bound a slot that extends in the longitudinal direction of the lever. The slot is open over its entire cross section at its two end faces. Introduced into the bottom of the slot is an oblong hole, which creates an opening to the top side of the adjusting lever. For mounting, the lever with its slot is pushed over the vane shaft until its opposite-lying claw surfaces are situated in rotationally fixed form fit with corresponding shaft surfaces. Subsequently, the lever is radially secured on the vane shaft by means of a screw element that is screwed into an inner thread bore of a free end of the vane shaft and is passed through the oblong hole.

In addition, a lever connection having a slot in a connecting section of an adjusting lever is shown in the patent EP 2 273 074 B1. In this solution, the slot is bounded by lateral hook elements, which, in the mounted state, engage in lateral grooves of a vane shaft. The slot is open to the top side of the adjusting lever via a bored hole for passage of a screw element.

SUMMARY OF THE INVENTION

An object of the invention is to provide a lever connection for a guide vane adjustment in a turbomachine for producing a connection between a guide vane and an actuator that eliminates the mentioned drawbacks. In addition, other objects of the invention are to create a method for producing a connection between a guide vane and an actuator, and to provide a turbomachine that, given a small structural space, makes possible a large number of adjustable guide vanes.

The object is achieved by a lever connection, by a method, and by a turbomachine of the present invention.

A lever connection for a guide vane adjustment in a turbomachine in accordance with the invention for producing a connection between a guide vane and an actuator, wherein the guide vane has a vane shaft that extends along its vertical axis and can be brought into connection with an adjusting ring of the actuator by means of a lever, provides that the vane shaft has a contact region that is reduced in cross section in comparison with a radially outer shaft region. The lever has a connecting section with an oblong hole and an insertion opening. The oblong hole has opposite-lying key flats for rotationally fixed operative connection with contact surfaces of the contact region. On the peripheral side, the insertion opening transitions into the oblong hole and, in comparison to the oblong hole, is expanded in cross section. In this case, it is expanded in cross section in such a way that the lever can be radially slid onto the vane shaft via the insertion opening by its connecting section.

Through the combination of oblong hole and insertion opening, a keyhole-shaped recess is created when viewed from the top and makes it possible for the vane shaft to have the same diameter in the region radially outside of the shaft-lever connection point as it does radially inside. The height of the contact surfaces for the transmission of the torque of the adjusting forces via the lever does not influence the outer diameter of the vane shaft, as is the case for conventional connections, such as wedge surfaces or cone geometries. Accordingly, it is possible to achieve a minimum diameter of 5 mm, driven by an M5 locking nut for the vane shaft. In this case, the radially outer part of the vane shaft can have the exact same diameter at the radially inner part of the vane shaft. A further advantage is that, once it reaches a desired position on the vane shaft, the lever cannot be raised, but rather virtually automatically enters into a self-secured rotationally fixed locking with the vane shaft once its desired position has been reached. The transmission of the torque from the actuator for the adjustment of the vanes thus occurs via the form fit.

In other words, owing to the insertion opening, the diameter of the contact region does not need to be larger than the outer diameter of the radially outer shaft region, as a result of which the lever connection according to the invention is also suitable for very small shaft diameters. Therefore, the vane shaft diameter is no longer the decisive value for the formation of the contact region. Accordingly, even for small vane shaft diameters, a reliable connection of the lever to the vane shaft is possible. In this way, the lever connection is suitable, in particular, for use in compressors of turbomachines that, given a small available structural space, require a high number of vanes, such as aircraft engines or compact industrial gas turbines. On account of the virtual absence of geometric constraints of the vane shaft, the shaft diameter can be markedly reduced.

In one embodiment, the form fit between the connecting section of the lever and the contact region of the vane shaft is achieved in that the key flats and the corresponding contact surfaces are each parallel surfaces. More preferably, the contact surfaces are identical in terms of their size and shape. For reasons of assembly technology, the key flats are likewise identical in terms of their size and shape. Alternatively, the key flats and the contact surfaces are positioned at an angle to each other. For example, as viewed in the longitudinal direction of the vane shaft, the key flats and the contact surfaces can be positioned virtually roof-shaped with respect to one another, similar to the legs of an equilateral triangle. Alternatively to a roof-shaped angular positioning with respect to one another, a polygonal, trapezoidal, and similar alignment and the like are conceivable. For example, the key flats and/or the contact surfaces can be positioned such that, in the transition region from the insertion opening to the oblong hole, lead-in chamfers are created, which form a kind of chute that tapers in the direction of mounting and facilitate the passage of the vane shaft out of the insertion opening into the oblong hole during mounting. It is essential that the key flats and the contact surfaces are not formed rotationally symmetrical to the vertical axis and that the form fit is free of play. Fundamentally, a key flat and a corresponding contact surface are already sufficient to achieve a rotationally fixed locking.

In terms of manufacturing technology, the contact surfaces can be created simply by cross-sectional taperings of the vane shaft. For example, they can be produced by milling. In addition, through the creation of cross-sectional taperings, shoulder surfaces are formed in the transition region of the contact surfaces to a shaft region that abuts the contact region radially inward and said shoulder surfaces act as a support for the connecting section in the mounted state.

By means of a screw element, the lever can additionally be clamped to the vane shaft. The screw element can be, for example, a nut that interacts with the radially outer shaft region, in particular a free end, of the vane shaft. The nut is preferably self-locking. Instead of an outer thread, it is also fundamentally possible to form an inner thread with appropriate adaptation of the nut. For securing the clamping, it is possible, in addition, to provide a securing element for arrangement between the connecting section and the screw element, said securing element having, for example, a bendable arm for lateral support on the screw element and/or the connecting section. After clamping, the at least one arm can rest against the screw element and/or the connecting section without use of an additional tool. In particular, it is also possible to provide a plurality of arms, so that, in the event that one arm fails, a reliable securing is still ensured. The transmission of the torque from the actuator for adjustment of the vanes occurs preferably exclusively via the form fit. The screw element serves primarily for securing the locking.

For connection of the lever to the adjusting ring, the lever can interact with an adjusting ring pin, which is aligned in such a way that the lever is mounted at the adjusting ring by means of a radial movement. Preferably, the lever has a passage or through bore hole, through which the respective adjusting ring pin is passed. This allows a fast and secure mounting. For specifying a desired position of the adjusting ring in the through bore hole on the side of the lever, the adjusting ring pin can have, for example, a annular shoulder, which acts as a slide or plunge stop. Preferably, the adjusting ring pin is fastened to the lever after it has reached it desired position.

In a method according to the invention for producing a connection between a guide vane and an actuator, wherein the guide vane has a vane shaft that extends along its vertical axis and is brought into connection with an adjusting ring of the actuator indirectly or directly by a lever, the lever is pushed radially from a first mounting direction onto the vane shaft and subsequently locked with the vane shaft in a form-fitting manner by way of movement in a second mounting direction. The first mounting direction and the second mounting direction are different. The first mounting direction and the second mounting direction are preferably orthogonal to each other; for example, the second mounting direction is oriented in the axial direction. The different second mounting direction results in a locking even without a clamping. The lever can now neither be raised nor moved radially inward or radially outward.

A preferred method comprises the following steps:

- radial pushing of the lever onto the vane shaft via an insertion opening on the lever side and radial connection of the lever to the adjusting ring;
- axial displacement of the adjusting ring with the lever along a lever-side oblong hole until opposite-lying key flats of the oblong hole are situated in contact with corresponding contact surfaces of the vane shaft;
- clamping of the lever with the vane shaft by interaction of a screw element with a radially outer shaft region, wherein the lever is radially clamped between shaft-side shoulder surfaces and the screw element.

A turbomachine according to the invention has a plurality of the lever connections according to the invention for producing a connection between guide vanes of an adjusting vane row and an actuator. Due to the lever connections according to the invention, guide vane adjustments are possible for guide vanes with very small shaft diameters and/or in a very tight spacing with respect to one another. For example, the guide vane adjustments of the front compressor stages or of the high-pressure compressors have lever connections of such a kind that the turbomachine can be equipped with a high-performance or optimized-performance compressor.

Other advantageous exemplary embodiments of the invention are discussed in detail below.

BRIEF DESCRIPTION OF THE DRAWING FIGURES

Figure 2:
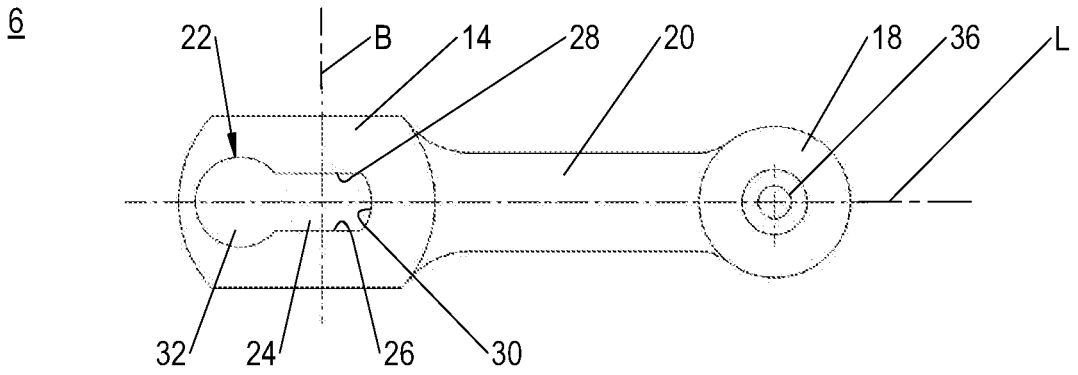
Figure 3:
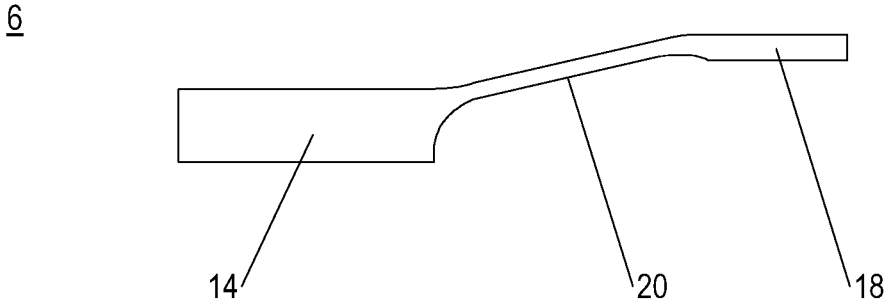
Figure 4:
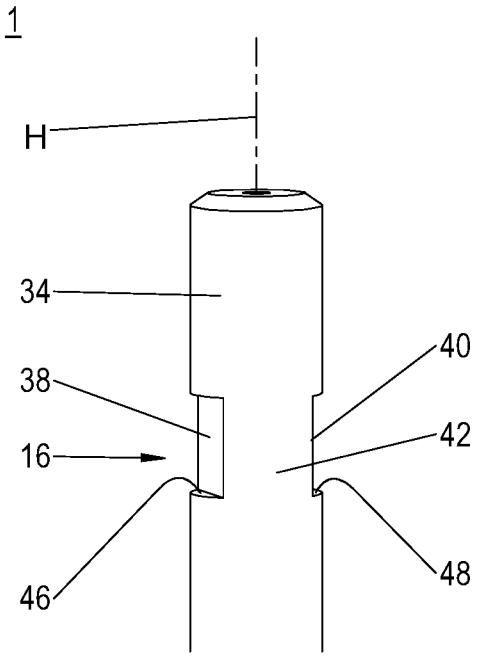
Figure 5:
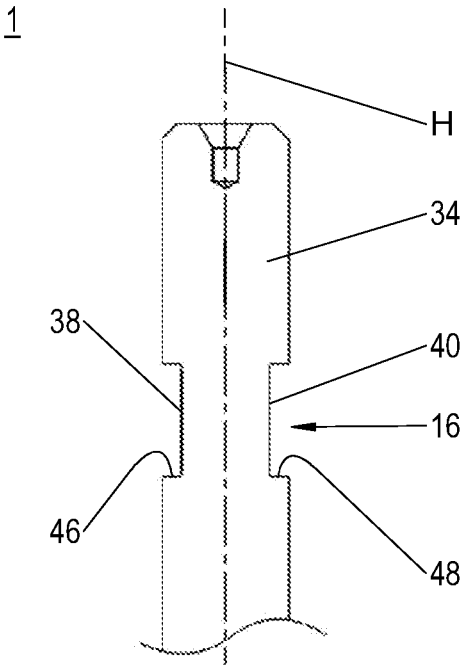
Figure 6:
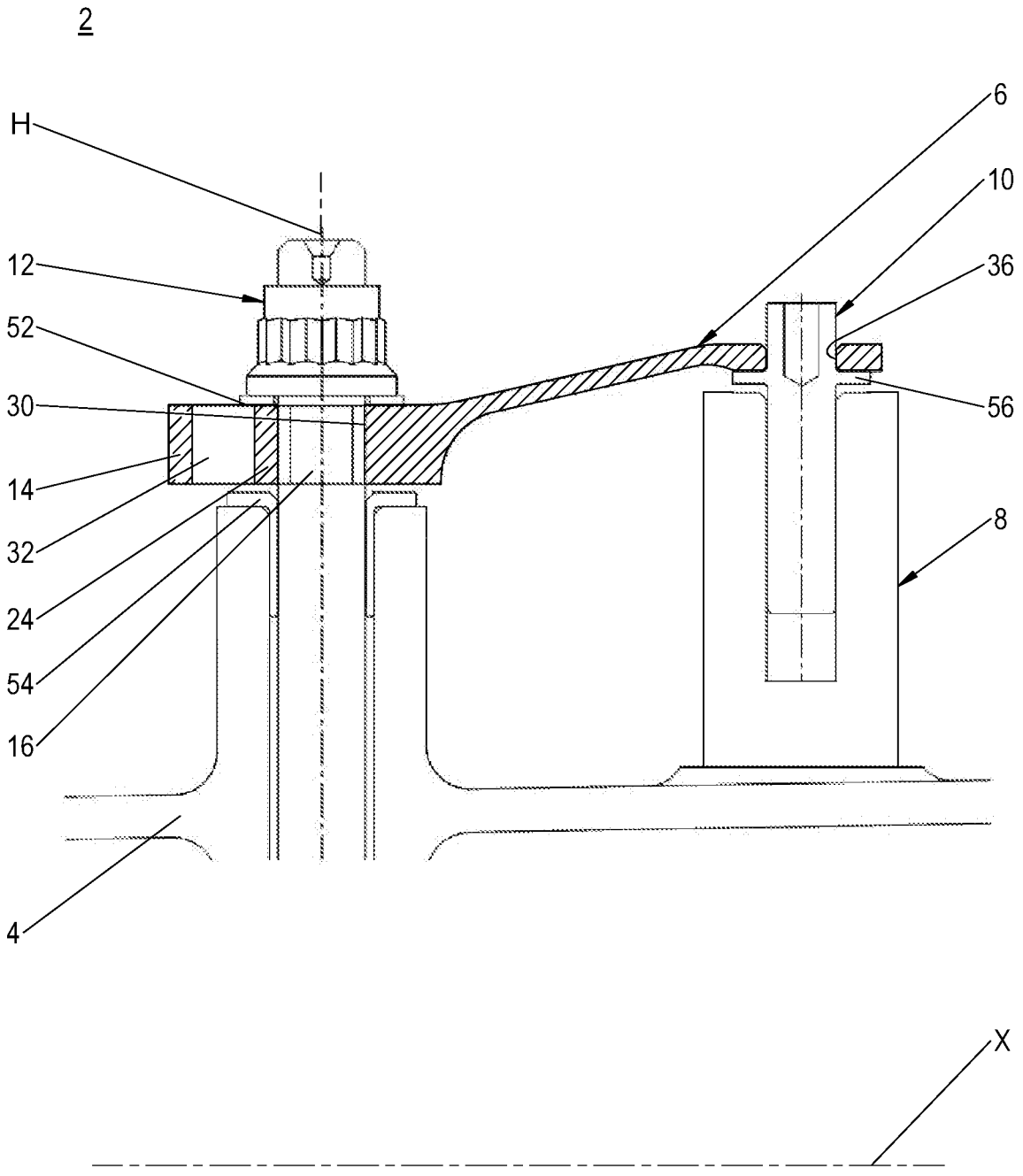

In the following, preferred exemplary embodiments of the invention are explained in detail on the basis of highly simplified schematic drawings. It is understood that individual elements and components can also be combined differently than those presented. Reference numbers for elements that correspond to each other are used throughout the figures, and, if appropriate, are not described again for each figure. Shown are:

FIG. 1: a perspective view from the top of a section for a guide vane adjustment with a lever connection according to the invention, FIG. 2: a top view of a lever of the lever connection, FIG. 3: a side view of the lever from FIG. 2, FIG. 4: a perspective top view of a section of a vane shaft of the lever connection, FIG. 5: a longitudinal section through the guide vane adjustment from FIG. 1, FIG. 6: a longitudinal section through the guide vane adjustment from FIG. 1, and FIGS. 7 to 9: mounting steps for mounting the lever connection.

DESCRIPTION OF THE INVENTION

In general, terms such as "radial," "radially outward or outer," "radially inward or inner," "coaxially," and "peripheral direction" refer here to a longitudinal axis X of the turbomachine according to the invention this axis representing the axis of rotation of a rotor of the turbomachine.

FIG. 1 shows a guide vane adjustment for guide vanes of an adjustable guide vane row of a turbomachine. Based on the chosen viewpoint from the outside onto a housing section of the turbomachine, from the rotating blades, only one vane shaft 1, leading radially outward from the vane element, is shown. The vane shaft 1 is usually also referred to as a radially outer bearing journal. Fundamentally, the guide vane has a vane element that is situated in a flow channel of the turbomachine through which the main flow passes. The guide vane is mounted in an inner ring via a bearing journal that is radially inward with respect to the vane element and surrounds a rotor shaft at a radial spacing. The turbomachine is, for example, an aircraft engine and the guide vane row is arranged in the compressor of the aircraft engine.

For the formation of a lever connection 2 for the guide vane adjustment in accordance with the invention, the guide vane has the vane shaft 1, which extends radially outward from the vane element and is guided out of the flow channel of the turbomachine and out of its housing 4 and extends along the vertical axis H of the guide vane. By means of an adjusting lever or lever 6 of the lever connection 2, which is situated outside of the main flow path of the turbomachine, the vane shaft 1 and thus the guide vane are in operative connection with an adjusting ring 8 that is arranged coaxially to the guide vane row and outside of the main flow path of the turbomachine. The adjusting ring 8 is shown schematically in FIG. 6. The connection of the lever 6 to the adjusting ring 8 is produced by way of adjusting ring pins 10. The clamping of the lever 6 to the vane shaft 1 is conducted by means of a screw element 12, such as, for example, a self-locking nut.

For adjustment of the guide vanes 1 around their vertical axes H, the adjusting ring 8 is shifted in place along the housing 4 via an actuator, which is not shown. The displacement then brings about a corresponding pivoting of the guide vanes around their vertical axes H. The transmission of the torque from the lever 6 onto the guide vane takes place by way of a form fit between the lever 6 and the vane shaft 1, which will be explained below. The screw element 12 serves primarily for securing the form fit. Each guide vane of the adjustable guide vane row is furnished with a lever connection 2 of this kind, each of which is connected to the adjusting ring 8.

As shown schematically in FIGS. 2 and 3, the lever 6 has a connecting section 14 for connection to a contact region 16 of the vane shaft 1, which is shown in FIGS. 4 and 5, and a connecting section 18 for connection with the adjusting ring pin 10. For reasons of clarity, the connecting section 18 for connection with the adjusting ring pin 10 is referred to as the connecting section in the following. The connecting section 14 and the connecting section 18 form the two ends of the lever 6 and are joined to each other via a strip-like lever section 20. The axis of rotation of the connecting section 14 around the vertical axis H and the axis of rotation of the connecting section 18 around a longitudinal axis of the adjusting ring pin 10 are parallel in this case and preferably extend in the radial direction. A possible radial offset of the connecting section 14 and of the connecting section 18 can be compensated by way of a strip-like lever section 20 by arranging each lever section 20 at an angle to the connecting section 14 and the connecting section 18, as is illustrated in FIG. 2. This angle can be 90°. Preferably, however, a longitudinal extension of the lever section 20 deviates from the essentially perpendicular line between the two axes of rotation. This facilitates the mounting of the lever 6.

In comparison to the strip-like lever section 20, the connecting section 14 is shown thickened and has a rectangular shape that extends in the longitudinal direction L of the lever 6. It has a keyhole-like recess 22, which passes through it in its thickness direction (perpendicular to the plane of the sheet in FIG. 2) from its top side to the bottom side.

The recess 22 is formed by an oblong hole 24, which extends in the longitudinal direction L of the lever and has two opposite-lying key flats 26, 28. The key flats 26, 28 are formed here as planar parallel surfaces, which are spaced apart from each other by a constant distance and extend in the direction of the longitudinal axis L of the lever. Via a concave surface 30, they are connected to each other near the strip-like lever section 20.

In addition, the recess 22 is formed by an insertion opening 32. As viewed from the strip-like lever section 20, the insertion opening 32 lies behind the oblong hole 24 and is open on the peripheral side with respect thereto. In other words, the insertion opening 32 transitions into the oblong hole 24 at the end thereof that faces away from the concave surface 30. In the exemplary embodiment shown here, the insertion opening 32 is formed as a through borehole having a circular cross section. In comparison to the oblong hole 24, the insertion opening 32 is expanded in cross section in the width direction B of the lever 6. In this case, it has a cross section such that the vane shaft 1 can be guided through by its radially outer free end 34, shown in FIGS. 4 and 5, or such that the lever 6 can be pushed onto the free end 34 of the vane shaft 1.

The connecting section 18 is thickened in comparison to the strip-like lever section 20, but not so much as the connecting section 14. It has a through borehole 36 for passing through the adjusting ring pin 10 or for pushing the lever 6 radially onto the adjusting ring pin 10.

The strip-like lever section 20 is designed here with a constant thickness and width. For compensation of radial heights with respect to the shaft-lever connection point and the adjusting ring pin-lever connection point, it is possible, via the strip-like lever section 20, for a height compensation between the connecting section 14 and the contact region 16 to be made by way of a corresponding deformation.

In accordance with FIGS. 4 and 5, the contact region 16 on the side of the vane shaft has two contact surfaces 38, 40, which face away from each other, for engagement of the lever-side connecting section 14. The contact surfaces 38, 40 are formed correspondingly to the key flats 26, 28 of the oblong hole 24 and thus are planar parallel surfaces here. They are flattened peripheral sections of the vane shaft 1 and are connected to each other via unchanged convex peripheral surfaces 42 of the vane shaft 1. On account of the perspective, only one peripheral surface 42 can be recognized. In particular, the contact surfaces 38, 40 are local cross-sectional taperings of the vane shaft 1, which are spaced apart from each other in such a way that, in the mounted state, a play-free or nearly play-free form fit with the key flats 26, 28 occurs. In this way, in contrast to the radially outer free end 34 or radially outer shaft region of the vane shaft 1 and in contrast to a radially inner abutting shaft region 44, the contact region 16 is not rotationally symmetric with respect to the vertical axis H, thereby fundamentally making possible a rotationally rigid fastening of the lever 6 by way of form fit.

In the transition region of the contact surfaces 38, 40 to the radially inner abutting original shaft region 44, shoulder surfaces 46, 48 are formed. The shoulder surfaces 46, 48 form supports for the connecting section 14 in the clamped state and bound a radial position of the lever 6 to the vane shaft 1. They generally make possible the clamping with the screw element 12.

The free end 34 of the vane shaft 1 is furnished with an outer thread, which is not illustrated, for interaction with the screw element 12 and hence is executed as a threaded segment. As shown schematically in FIG. 7, the outer thread or the free end 34 is spaced apart from the contact region 16 via an annular groove 50. Fundamentally, it is also possible, instead of an outer thread, to provide an inner thread in the free end 34 for interaction with a corresponding screw element 12.

In FIG. 6, the locking and clamping of the lever 6 to the vane shaft 1 in the contact region 16 is shown in a cut. It can clearly be seen how the vane shaft 1 is arranged not in the insertion opening 32, but rather in the oblong hole 24 and, in particular, passes through the latter. In the exemplary embodiment shown here, the concave surface 30 of the oblong hole 24 acts as an axial stop for the vane shaft 1. However, a contact is not absolutely necessary. Instead, the oblong hole 24 allows the compensation of manufacturing and mounting tolerances, so that the vane shaft 1 can also fundamentally be spaced apart from the concave surface 30 in its mounted position, as long as it is situated in the oblong hole 24.

In addition, the clamping of the lever 6 by means of the screw element 12 can be seen. The connecting section 14 is clamped between the shoulder surfaces 46, 48 and the screw element 12 and in this case is radially spaced apart from the housing 4 of the turbomachine. In addition, it is possible, as shown, for a washer 52 to be placed on the vane shaft 1 between the connecting section 14 and the screw element 12. In order to make possible a readily accessible adjustment of the guide vane around its vertical axis H, the vane shaft 1 is guided through a bearing bushing 54, which is inserted in the housing 4.

Furthermore, it can be seen in FIG. 6 how the lever 6 interacts with the adjusting ring pin 10. The latter is guided through the through borehole 36 in the connecting section 18 of the lever 6 and, for adjustment of its insertion depth, has an annular shoulder 56, which, at the same time, forms a radial support for the lever 6.

Furthermore, the radial height difference between the shaft-lever connection point and the adjusting ring pin-lever connection point can clearly be seen. In the exemplary embodiment shown here, the connection on the side of the vane shaft is situated radially inward with respect to the connection on the side of the adjusting ring.

In addition, as viewed in the flow direction, the shaft-lever connection point is arranged here behind the adjusting ring pin-lever connection point. Of course, as viewed in the flow direction, the shaft-lever connection point can also be arranged in front of the adjusting ring pin-lever connection point. The axial position of the connection points with respect to one another defines, among other things, a free mounting space outside of the housing 4.

Figure 7:
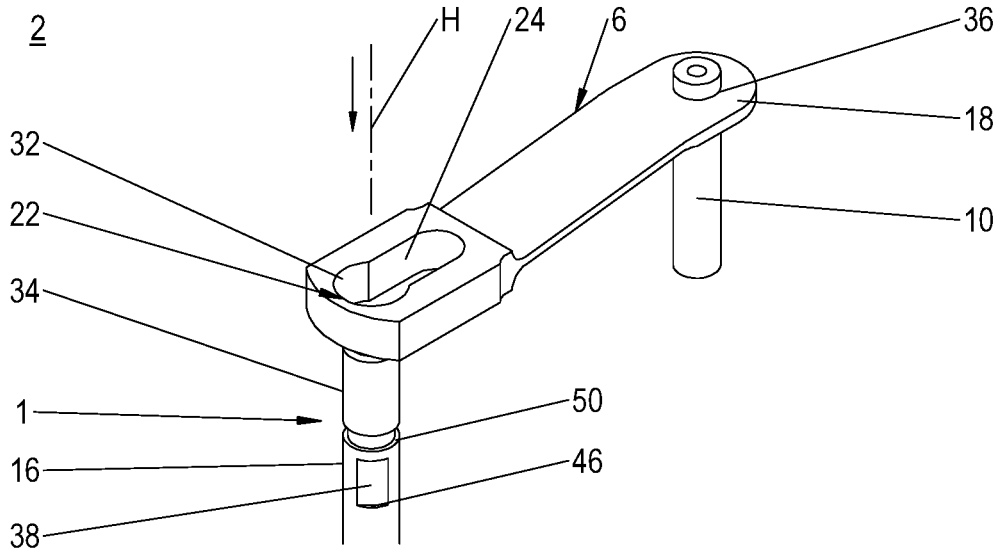
Figure 8:
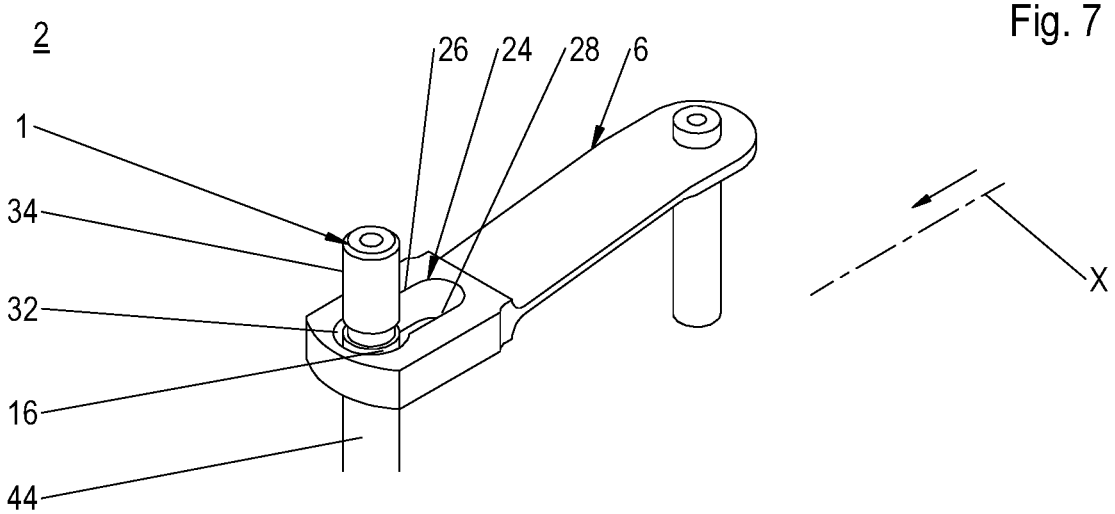

In a method according to the invention for mounting the lever connection 2 according to the invention to a vane shaft 1 of a guide vane of a guide vane row, it is essential that the lever 6 of the lever connection 2 is pushed, in a first mounting direction, radially or essentially radially, onto the contact region 16 of the vane shaft 1 (FIG. 7) and is locked with the vane shaft 1 in a form-fitting manner by means of a movement in an axial or essentially axial second mounting direction (FIG. 8). Prior to radially pushing the lever 6 onto the shaft-side contact region 16, the lever 6 is mounted on the adjusting ring 8 from a mounting direction that is the same as the first mounting direction. Accordingly, after the mounting of the adjusting ring pin 10, the lever 6 is moved radially until it is situated with its connecting section 14 in contact with the contact region 16 of the vane shaft 1. However, the movement in the second mounting direction occurs only when all levers 6 have been placed on the respective vane shaft 1 and are inserted in the adjusting ring 8.

In the following, the method according to the invention will be explained in detail on the basis of FIGS. 7 to 9. As mentioned previously, terms such as "radial" refer to the machine longitudinal axis X of the turbomachine according to the invention, which represents the axis of rotation of a rotor of the turbomachine.

At the beginning of the mounting (FIG. 7), an adjusting ring pin 10 is fastened to the respective lever 6. To this end, the adjusting ring pin 10 is guided up to the annular shoulder 56 through the through borehole 36 of the connecting section 18 and then connected to it.

Subsequently (FIGS. 7 and 8), the lever 6 is pushed radially onto the vane shaft 1 by means its insertion opening 32 of the keyhole-like recess 22, that is, in the direction of the arrow along the vertical axis H, over the free end 34 thereof. The lever 6 then encompasses, by its insertion opening 32, the shaft-side contact region 16 (FIG. 8). The adjusting ring pin 10 is accordingly introduced radially into an opening 58 of the adjusting ring 8 (see FIG. 6).

Figure 9:
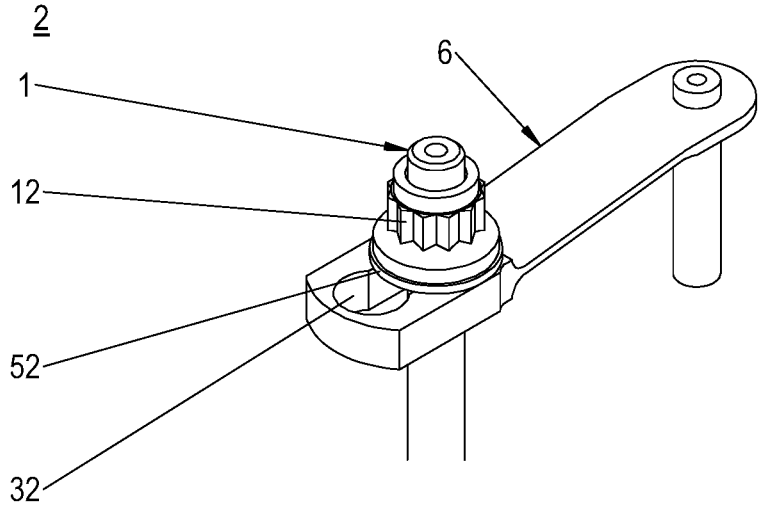

The form fit is then produced between the lever 6 and the vane shaft 1 (FIGS. 8 and 9). To this end, the adjusting ring 8 (which is not illustrated) with the lever 6 is advanced axially in the direction of the vane shaft 1, that is, along the machine longitudinal axis X in the direction of the arrow, in such a way that the contact region 16 transitions out of the insertion opening 32 into the oblong hole 24 of the keyhole-like recess 22. The key flats 26, 28 of the oblong hole 24 are now situated in contact with the contact surfaces 38, 40 of the contact region 16. Accordingly, the rotationally rigid form fit between the lever 6 and the vane shaft 1 is produced. At the same time, on account of the enlarged diameter of the free end 34 of the vane shaft 1 and of the vane region 44 abutting the contact region radially inward, the lever 6 is locked on the vane shaft 1 in the radial direction.

Once the axial displacement has occurred, the form fit is secured (FIG. 9). To this end, the lever 6 is clamped by means of the screw element 12 against the shoulder surfaces 46, 48 of the vane shaft 1. The screw element 12 is screwed onto the outer thread of the free end 34. Due to the radial support of the vane shaft 1 on the shoulder surfaces 46, 48, the connecting section 14 cannot deviate radially inward. In consequence, the connecting section 14 is pressed against the shoulder surfaces 46, 48. The securing of the screw element 12 against loosening rotational movements is produced by way of self-locking. In addition, the washer 52 can be formed as a locking washer with, for example, lateral arms that rest laterally against the screw element 12 and/or are inserted in the insertion opening 32.

It is noted that the invention also comprises exemplary embodiments in which the adjusting ring pins 10 are not pre-mounted with the levers 6. For example, the adjusting ring pins 10 can be mounted beforehand on the adjusting ring 8 and then the levers 6 are pushed onto the respective ring pin 10 that is mounted on the adjusting ring 8.

Disclosed is a lever connection for a guide vane adjustment for connecting a guide vane of a turbomachine to an adjusting ring of an actuator, which is arranged in such a way that an adjusting lever of the lever connection is pushed radially from a first mounting direction, in relation to a machine longitudinal axis of the turbomachine, onto a vane shaft of the guide vane and locked with the vane shaft in a form-fitting and, in particular, rotationally rigid manner by means of a movement in a second mounting direction; a mounting method; and a turbomachine.

What is claimed is:

1. A lever connection for a guide vane adjustment in a turbomachine for producing a connection between a guide vane and an actuator, wherein the guide vane has a vane shaft, which extends along its vertical axis and can be brought into connection with an adjusting ring of the actuator by a lever, wherein the vane shaft has a contact region, which is reduced in cross section in comparison to a radially outer vane shaft region, wherein the lever has a connecting section with an oblong hole and an insertion opening, wherein the oblong hole has key flats for rotationally rigid operative connection with correspondingly formed contact surfaces of the contact region and the insertion opening transitions on a peripheral side into the oblong hole, and wherein the insertion opening is enlarged in cross section in comparison to the oblong hole and is arranged in such a way that the lever can be pushed radially by its connecting section onto the vane shaft via the insertion opening.

2. The lever connection according to claim 1, wherein the key flats and the contact surfaces are parallel surfaces.

3. The lever connection according to claim 1, wherein the contact surfaces are formed by lateral cross-sectional taperings of the vane shaft, and the contact surfaces transition via respective shoulder surfaces to a shaft region, which abuts the contact region radially inward, and form contact supports for the connecting section.

4. The lever connection according to claim 1, wherein clamping of the lever to the vane shaft occurs by a screw element that interacts with the radially outer shaft region.

5. The lever connection according to claim 4, wherein, when the screw element is mounted, the connecting section of the lever is clamped between the respective shoulder surfaces and the screw element.

6. The lever connection according to claim 1, wherein the lever interacts with an adjusting ring pin for connection to the adjusting ring, which is arranged such that the connection to the adjusting ring is made by radial movement of the lever.

7. The lever connection according to claim 1, wherein a plurality of lever connections are configured and arranged for producing a connection between guide vanes of an adjusting vane row and an actuator.

* * * * *